US009637204B2

(12) United States Patent
Le Devehat et al.

(10) Patent No.: US 9,637,204 B2
(45) **Date of Patent: *May 2, 2017**

(54) DEVICE FOR PROVIDING INFORMATION ON POSITIONING OF A MOVEABLE COUPLING OF A MARINE FLUID LOADING SYSTEM

(71) Applicant: FMC Technologies SA, Sens (FR)

(72) Inventors: Renaud Le Devehat, Thorigny-sur-Oreuse (FR); Nicolas Sylard, Auxerre (FR)

(73) Assignee: FMC Technologies S.A., Sens (FR)

( * ) Notice: Subject to any disclaimer, the term of this patent is extended or adjusted under 35 U.S.C. 154(b) by 238 days.

This patent is subject to a terminal disclaimer.

(21) Appl. No.: 14/222,501

(22) Filed: Mar. 21, 2014

(65) Prior Publication Data

US 2014/0205398 A1 Jul. 24, 2014

Related U.S. Application Data

(63) Continuation of application No. 12/736,790, filed as application No. PCT/IB2008/002686 on Jun. 23, 2008, now Pat. No. 8,742,941.

(30) Foreign Application Priority Data

May 22, 2008 (FR) ..... 08 53347

(51) Int. Cl.
*G08B 21/00* (2006.01)
*B63B 27/24* (2006.01)
(Continued)

(52) U.S. Cl.
CPC ..... *B63B 27/24* (2013.01); *B67D 9/02* (2013.01); *G08B 21/182* (2013.01)

(58) Field of Classification Search
CPC ..... B63B 27/25; B67D 9/00
(Continued)

(56) References Cited

U.S. PATENT DOCUMENTS 4,205,308 A * 5/1980 Haley ..... B25J 9/1676 137/556
4,402,350 A 9/1983 Ehret et al.
(Continued)

FOREIGN PATENT DOCUMENTS

CN 1570796 1/2005
GB 2 008 287 A 5/1979
(Continued)

*Primary Examiner* — Phung Nguyen

(57) ABSTRACT

A device for providing information on the positioning of a moveable coupling located on a movable end of a fluid transfer line, the other end of which is fixed to a base, includes a first GPS device which is positioned on or adjacent the coupling and provides information on the absolute positioning of the coupling in space, and a second apparatus which is adapted to cooperate directly with the first apparatus and provides information on the positioning of the base. The second apparatus is disposed on or adjacent the base and provides, on the basis of the information on the positioning of the base and the information on the positioning of the coupling, information on the relative positioning of the coupling directly relative to the base. Alternatively, the first apparatus is adapted to provide information on the absolute positioning of the coupling in space, the base has a fixed position in space, and the device comprises a calculator for calculating, on the basis of the information on the absolute positioning of the coupling and data on the positioning of the base, information on the relative positioning of the coupling directly relative to the base.

19 Claims, 4 Drawing Sheets

(51) Int. Cl.
*B67D 9/02* (2010.01)
*G08B 21/18* (2006.01)

(58) Field of Classification Search
USPC ..... 340/669, 506, 539.23, 686.6, 685; 414/137.1
See application file for complete search history.

(56) References Cited

U.S. PATENT DOCUMENTS

| | | | | |
|---|---|---|---|---|
| 4,408,943 | A * | 10/1983 | McTamaney | B63B 27/24 114/74 R |
| 4,758,970 | A | 7/1988 | Keary et al. | |
| 6,114,975 | A | 9/2000 | Guillard | 340/848 |
| 7,147,022 | B2 | 12/2006 | Le Devehat | 41/387 |
| 7,469,863 | B1 * | 12/2008 | Speer | B64D 39/00 244/135 A |
| 7,954,512 | B2 | 6/2011 | Le Devehat | |
| 8,181,662 | B2 | 5/2012 | Pollack et al. | |
| 2002/0103596 | A1 | 8/2002 | Zhu et al. | |
| 2002/0117609 | A1 | 8/2002 | Thibault et al. | |
| 2003/0195676 | A1 | 10/2003 | Kelly et al. | |
| 2004/0089735 | A1 | 5/2004 | Drechsel | |
| 2004/0102876 | A1 | 5/2004 | Doane | 701/9 |
| 2005/0014499 | A1 | 1/2005 | Knoblach et al. | |
| 2008/0109108 | A1 | 5/2008 | Lawson | |

FOREIGN PATENT DOCUMENTS

| | | | |
|---|---|---|---|
| GB | 2 030 654 | A | 4/1980 |
| GB | 2 184 090 | A | 6/1987 |
| JP | 53-51875 | A | 5/1978 |
| JP | 63-76700 | U | 5/1988 |
| JP | 2003-276677 | A | 10/2003 |
| JP | 2005-096585 | A | 4/2005 |

* cited by examiner

DEVICE FOR PROVIDING INFORMATION ON POSITIONING OF A MOVEABLE COUPLING OF A MARINE FLUID LOADING SYSTEM

This application is a continuation of U.S. patent application Ser. No. 12/736,790 filed on Nov. 8, 2010, now U.S. Pat. No. 8,742,941.

BACKGROUND OF THE INVENTION

The present invention generally relates to systems for loading and/or unloading fluids for ships, commonly referred to as marine loading systems. These systems are used to transfer a fluid product between a ship and a quay or between two ships. Fluid product is understood to mean a liquid or gaseous product. More particularly, the present invention concerns a device for providing information on positioning of a coupling and for alarm provision, for the movement of such a loading and/or unloading system.

Generally, marine loading systems have a fluid transfer line end that is fixed to a base and connected to a tank of fluid to be transferred, and an opposite line end that is moveable and provided with a coupling adapted for connecting to a target duct, itself connected to a fluid tank.

The movement of the moveable coupling is controlled by actuators which are themselves controlled by a control device that is controlled by an operator. When the coupling is moved too far from the base, there is a risk of damage to the system, in particular by rupture or interference. When the coupling is moved too far from the base during extension there is a risk of rupture of the system. When the coupling is rotated relative to the base, in particular when several loading systems are disposed in parallel on a quay, there is a risk of collision with the neighboring loading systems: the term damage by interference is used. Furthermore, there is a risk of rupture on rotation.

To avoid the damage or rupture of the marine loading system, alarm devices have been provided on certain types of loading devices.

In general terms, the present invention aims to improve these alarm devices for fluid loading devices for ships.

Two families of fluid loading systems for ships are known, which are distinguished by their structure: systems for transfer by rigid pipes and systems for transfer by flexible pipes. In the family of systems for transfer by rigid pipes, loading arm systems and pantograph systems can be distinguished.

The loading arm is an articulated tubing arrangement, having a base, connected to fluid tank, on which there is mounted a first pipe, designated inner pipe, via a portion of tube with a 90° bend enabling rotation of one of its ends about a vertical axis, and the other end about a horizontal axis. At the opposite end of the inner tube, a second pipe, designated the outer pipe, is rotatably mounted about a horizontal axis. A coupling is mounted at the end of the outer pipe. Each of the three rotations is controlled by a jack or hydraulic motor.

In the case of loading arms, the use of proximity detectors is known for triggering alarms. These proximity detectors are placed at the base for the alarms concerning the rotation of the inner pipe relative to the base, and on the inner and outer tube to trigger alarms during extension of the loading arm. In practice, the operation of such proximity detectors is simple: a cam, mounted on a member of the loading arm, passes in front of a corresponding proximity detector, itself attached to another member of the loading arm, which triggers one or more alarms. According to the positioning of the sensors, the alarm is triggered for example when the system is too extended or has too high an angle relative to the base.

This type of detector only gives information of on-off type, that is to say that the alarms are triggered when the operator makes the loading arm leave a predefined zone, designated working zone. In other words, the operator is informed by an alarm only when he goes outside the working zone but has no information when he is within said working zone, or near the limit of the working zone.

Another system known for a loading arm comprises angle sensors disposed on different moveable members of the loading arm. This makes it possible to know at any time the relative angles of each member of the loading arm relative to a neighboring member or relative to the vertical, by using pendulum sensors, and to determine thereby the position of the coupling relative to the base, and to deduce therefrom whether it is necessary to trigger an alarm or not.

These alarm devices enable an alarm to be triggered with a greater or lesser degree of alert, and furthermore, in certain cases, enable emergency sequences to be triggered. Moreover, these devices enable alarms or emergency sequences to be triggered in anticipation, when the loading arm approaches the limit of the working zone at a speed greater than a predetermined speed.

The pantograph systems, like the loading arms, have a base connected to a tank. A crane is rotatably mounted on that base. The crane has a boom carrying a pipe for the fluid. At the end of the boom there is mounted a pantograph composed of articulated pipes for the fluid, and enabling a coupling to be moved that is mounted at the free end of the pantograph. The inclination of the pantograph is controlled by a rotation at the end of the boom. The movement of the pantograph is controlled by hydraulic motors and by a jack for the rotation on the base.

In the case of pantograph systems, the use of systems triggered by proximity sensors is known for the rotation relative to the base and by wire or incremental sensor for the length along the boom and the unfolded length of the pantograph.

Generally, alarm devices for loading systems with rigid piping have other drawbacks.

The loading system must imperatively have a structure with precise kinematics known in advance in order to be able to judiciously locate thereon angle and position sensors and/or overshoot sensors.

It is necessary to locate sensors between each articulated member from the base to the coupling to obtain information on positioning of the coupling relative to the base. The sensors thus depend on the structure of the loading system. The cumulative error of this "chain" of sensors has a negative impact on the precision of the positioning of the coupling.

Lastly, the flexible piping systems generally have a line in which is conveyed the fluid product and a mechanical system enabling the line to be maneuvered. There are several types of maneuvering systems, but in all cases they include a manipulating crane or structure which supports the coupling for connecting the flexible piping.

To date, no distance measuring system exists enabling alarms to be triggered for the systems with flexible piping.

SUMMARY OF THE INVENTION

In general terms, the present invention concerns the provision of an improvement for a device for providing information on positioning of a coupling of a marine loading system that is moveable relative to its base, to improve the precision of the positioning information and to sir simplify the known devices, and furthermore concerns the provision of a device for providing information on positioning of a moveable coupling able to be adapted to any type of marine loading system not equipped therewith, whatever be its structure, with rigid or flexible piping.

To that end it provides a device for providing information on positioning of at least one moveable coupling of a marine loading system, the system comprising at least one fluid transfer line having a line end fixed to a base, and a moveable line end provided with a coupling adapted for connection to a target duct, the coupling or a member immediately neighboring the coupling comprising at least one means for providing information on the positioning of the coupling either adapted to cooperate directly with a means for providing information on positioning of the base disposed on the base or on a member immediately neighboring the base to provide, on the basis of the information on positioning of the base, information on relative positioning of the coupling directly relative to the base, or adapted to provide information on absolute positioning of the coupling in space, and, the base having a fixed position in space, the device comprises a calculating means making it possible to calculate on the basis of the information on absolute positioning of the coupling and data on positioning of the base fixed in space, information on relative positioning of the coupling directly relative to the base.

Advantageously, the present invention uses means making it possible either to provide information on positioning of the coupling directly relative to the base, or by capturing information on absolute positioning of the coupling then calculating the relative distance of the coupling directly relative to the base.

In both cases, advantageously, the measurements are no longer based on the relative positioning of the members of the loading system, but on the positioning of the coupling directly relative to the base. This makes it possible to be free relative to the type of mechanical structure that there may be between the base and the coupling (for example an arm or a pantograph), and thus easily adapt this system to any type of marine loading system both equally well with the systems of transfer by rigid piping, as with the systems of transfer by flexible piping. With the device according to the invention, the precision of the information on positioning of the coupling is greater, since there are no intermediate sensors. This makes the device according to the invention simpler and more precise than the known devices.

According to an advantageous feature of the invention, the device comprises calculation means adapted to:

- calculate, in real time, the information on positioning of the coupling relative to the base, and the calculating means having data defining at least one authorized positioning zone for the coupling,
- check, in real-time, whether the coupling is located within the authorized zone,
- emit a specific alarm when the coupling leaves the corresponding authorized zone.

Thus, authorized zones or working zones are defined virtually by the calculating means. It is not necessary to provide sensors or switches physically disposed on the loading system to define such zones. They can be parameterized easily via the calculating means.

This makes it possible to increase the safety of use by virtue of alarms triggered more precisely. Furthermore, it is possible to provide a plurality of authorized zones, for example overlapping one within the other, having different degrees of working risk, and corresponding to different alarms according to whether the work in the zone concerned bears a greater or lesser risk.

Immediately neighboring members is understood to mean members of the marine loading system which are fixed or moveable relative to the coupling or the base respectively, but sufficiently close thereto whatever the geometric configuration of the loading system, to give precise information as to the relative positioning of the coupling relative to the base, in particular to emit a specific alarm when the coupling leaves an authorized zone that has been parameterized.

According to an advantageous feature of the invention, the calculating means are adapted to calculate in real time the speed of movement of the coupling and to trigger an alarm in anticipation when the coupling approaches the limit of the corresponding authorized zone with a speed greater than a predetermined speed (i.e., too fast).

Advantageously, this makes it possible to increase the safety of use by virtue of alarms triggered in anticipation when the movement of the coupling is too fast towards a limit of the authorized zone.

According to advantageous features, which may be combined:

- the means for providing information on the positioning of the coupling includes a device of a system for global positioning in particular of GPS type, making it possible to give information on absolute positioning of the coupling in space;
- the means for providing information on the positioning of the base includes a device of a system for global positioning in particular of GPS type, making it possible to give information on absolute positioning of the base, the calculating means being adapted to calculate, on the basis of the information on absolute positioning of the coupling and of the base, the relative positioning of the coupling relative to the base;
- the devices for global positioning in particular of GPS type are devices designed to communicate with each other so as to directly provide information on the relative position of the coupling relative to the base, to the calculating means;
- one of the means for providing information on positioning of the coupling or of the base includes an optical device, adapted to cooperate with the base or the coupling respectively or a target that is fixed relative to the base or relative to the coupling respectively, by emitting a luminous beam, such as a laser beam, towards the base or the coupling or a target that is fixed relative to the base or the coupling respectively, and to detect the reflected beam and to measure the travel time of the beam to deduce therefrom information on relative positioning of the coupling directly relative to the base;
- one of the means for providing information on positioning of the coupling or of the base is an optical camera, adapted to provide, to the calculating means, an image of the base or of the coupling respectively, or of a target that is fixed relative to the base or the coupling respectively, the calculating means being adapted to process the image provided by the camera to calculate the elative positioning of the coupling relative to the base.
- said at least one means for providing information on positioning of the coupling or of the base includes at least one cord tensioned using a reel between the coupling and the base and at least one angle sensor and/or at least one unwound cord length sensor on the reel, chosen so as to provide the calculating means with information making it possible to calculate the relative positioning of the coupling relative to the base.

When the loading system comprises several lines, their bases are disposed in parallel on the same quay and the corresponding couplings are connected to target ducts disposed in parallel on the same ship. In this case, the distances between the couplings no longer vary, since they are connected to target ducts attached to the same ship. It is then useful to check relative to each other the possible variations in distance between the couplings in order to verify the consistency of the information provided by the various means for providing information on positioning of the couplings and the proper operation of those means.

Advantageously, to that end, the present invention provides a device comprising calculating means that are adapted, when the loading system comprises several lines, their bases being disposed on the same quay and the corresponding coupling being connected to target ducts disposed on the same ship, to:

calculate on the basis of the information on positioning of the couplings, the distances between the couplings immediately after the connection of the set of couplings to the corresponding target ducts, store said distances as reference distances, calculate, in real time, the distances between the couplings, on the basis of the formation on positioning of the couplings, compare, in real time, the calculated distances with the reference distances, and emit an alarm when the calculated distances vary relative to the reference distances beyond a predefined threshold.

Such a comparison makes it possible to identify a means for providing information on positioning of the defective coupling.

According to another aspect, the invention provides a method for calculating means of a device as described above comprising the following calculating steps:

calculating, in real time, the information on positioning of the coupling relative to the base, and the calculating means having data defining at least one authorized positioning zone for the coupling, checking, in real-time, whether the coupling is located within the authorized zone, and emitting a specific alarm when the coupling leaves the corresponding authorized zone.

According to another aspect, the invention provides a calculator for a device as described above that is adapted for:

calculating, in real time, the information on positioning of the coupling relative to the base, and the calculating means having data defining at least one authorized positioning zone for the coupling, checking, in real-time, whether the coupling is located within the authorized zone, and emitting a specific alarm when the coupling leaves the corresponding authorized zone.

The explanation of the invention will now be continued with the detailed description of an embodiment, given below by way of non-limiting example, with reference to the accompanying drawings.

DETAILED DESCRIPTION OF THE INVENTION

Figure 1:
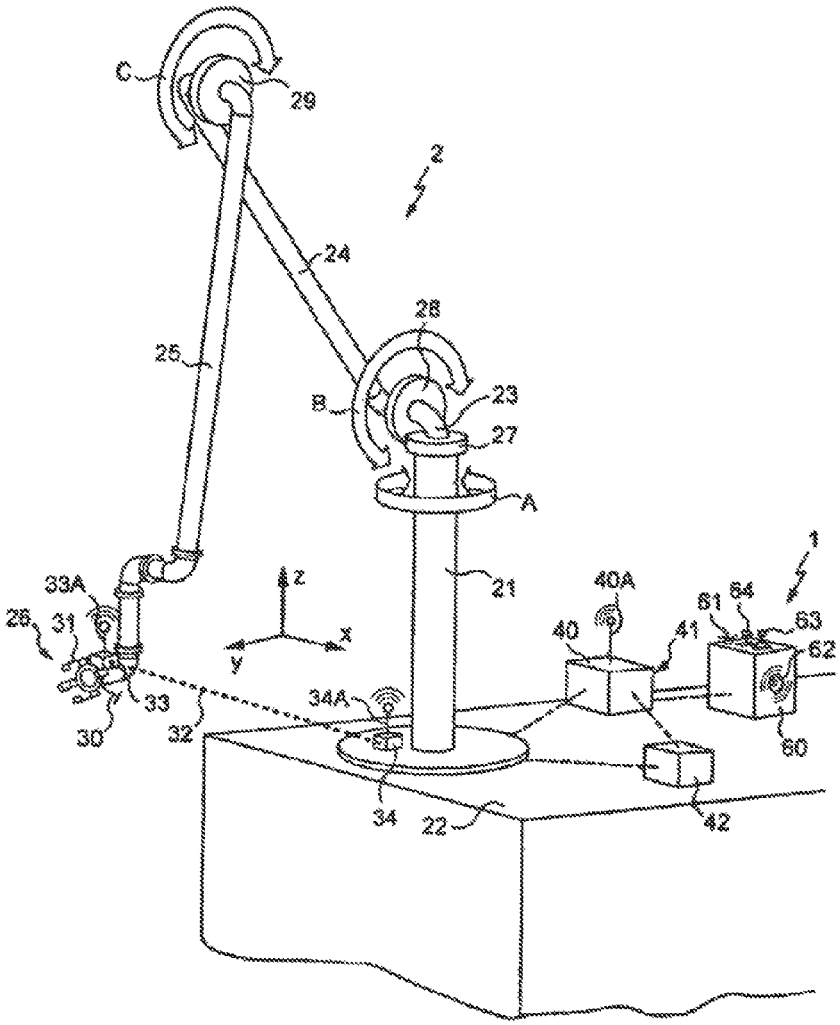
FIG. 1 is a diagrammatic view in perspective of a loading arm equipped with a device according to the invention.

FIG. 1 is a very diagrammatic representation of a loading arm 2 equipped with a control device 1 according to the invention. The representation of the loading arm here is very simplified, and it should be re fled in this connection that the device for providing information on positioning according to the invention can adapt to any type of marine loading system, in particular to the loading systems described above.

The loading arm of FIG. 1 has a base 21 connected to a fluid tank which is located below the surface 22 on which the base is fixed, and which may for example be a quay or the deck of a ship. At the apex of the base there is rotatably articulated a bent tube 23, on which is articulated in turn a first tube referred to as inner tube 24 which is articulated at its opposite end with a second tube referred to as outer tube 25. The end of the outer tube carries a coupling 26 adapted to be connected to a target duct (not shown).

In the embodiment represented, in a manner known per se, the coupling has three degrees of freedom in rotation relative to the end of the outer tube. In the present embodiment, these three rotations are free, such that an operator may freely adjust the angle of the coupling during the final phase of approach for the connection of the coupling to the target pipe.

In an alternative embodiment, not shown, one or more of these rotations are controlled by actuators and connected to a command interface to enable the operator directly to control the rotations on the final approach of the coupling.

In a manner known per se, the coupling in the present embodiment comprises locking claws 31 which are closed by an actuator 30 represented very diagrammatically to hold the coupling 26 around the target duct, once they are connected.

Generally, this type of loading arm is known per se, and will not be described in more detail here. It will moreover be recalled that the device according to the invention adapts to all marine loading systems, and that the adaptation of the control device according to the invention to any other type of loading system, in particular one of the systems described above, is within the capability of the person skilled in the art.

In the device according to the invention as represented diagrammatically in FIG. 1, actuators 27, 28, 29 are provided at each of the three articulations of the loading arm (symbolized by the double arrows A, B, C). More specifically, a first actuator 27 is provided between the apex of the base 21 and the bent tube 23, to pivot the latter horizontally relative to the base, a second actuator 28 is provided between the end of the bent tube 23 and the inner tube 24 so as to pivot the inner tube vertically, and a third actuator 29 is provided between the inner tube 24 and the outer tube 25 to make the latter pivot vertically.

The three actuators 27, 28, 29 are hydraulic jacks here represented very diagrammatically in FIG. 1. In a variant not illustrated, one or more of the hydraulic jacks are replaced by hydraulic motors. According to another variant not illustrated, the actuators are electric or pneumatic motors.

The base 21 is provided with a box 34 enclosing a means for providing information on positioning of the base which is, in the present embodiment, a device of a system for global positioning of GPS type, enabling an absolute position to be given, and more particularly the spatial coordinates of the base.

The same applies for the coupling 26, which comprises a box 33 enclosing a device of a system for global positioning of GPS type, enabling an absolute position to be given, and more particularly the spatial coordinates of the connecting end of the coupling. Alternatively, the box 33 is disposed on a member immediately neighboring the coupling such as one of the tubes articulated to the end of the arm. In practice, the calculating means are adapted to extrapolate the information on positioning of the coupling itself, on the basis of the means for providing information on positioning disposed on the immediately neighboring member.

The calculating means of the control device are joined with a calculator 41 disposed in an electrical control cabinet 40.

A hydraulic power unit 42 is provided to supply the actuators with the hydraulic energy necessary for their operation. It is controlled by the calculator 41.

The boxes 33 and 34 are furthermore respectively provided with a reflective target and an emitter/receiver of a laser light beam 32, which are adapted to provide information on the distance which separates the base and the coupling. In practice, the travel time of the laser beam is measured to deduce the distance.

Moreover, the boxes 33 and 34 are each respectively provided with a radio transmitter device 33A and 34A to transmit a signal comprising positioning information. The calculator is linked to a receiver device 40A adapted to receive said signals from the transmitters 33A and 34A. The control device furthermore comprises a command interface 60 for an operator, to control the movement of the coupling according to the x, y, z axes that can be seen in FIG. 1.

Figure 2:
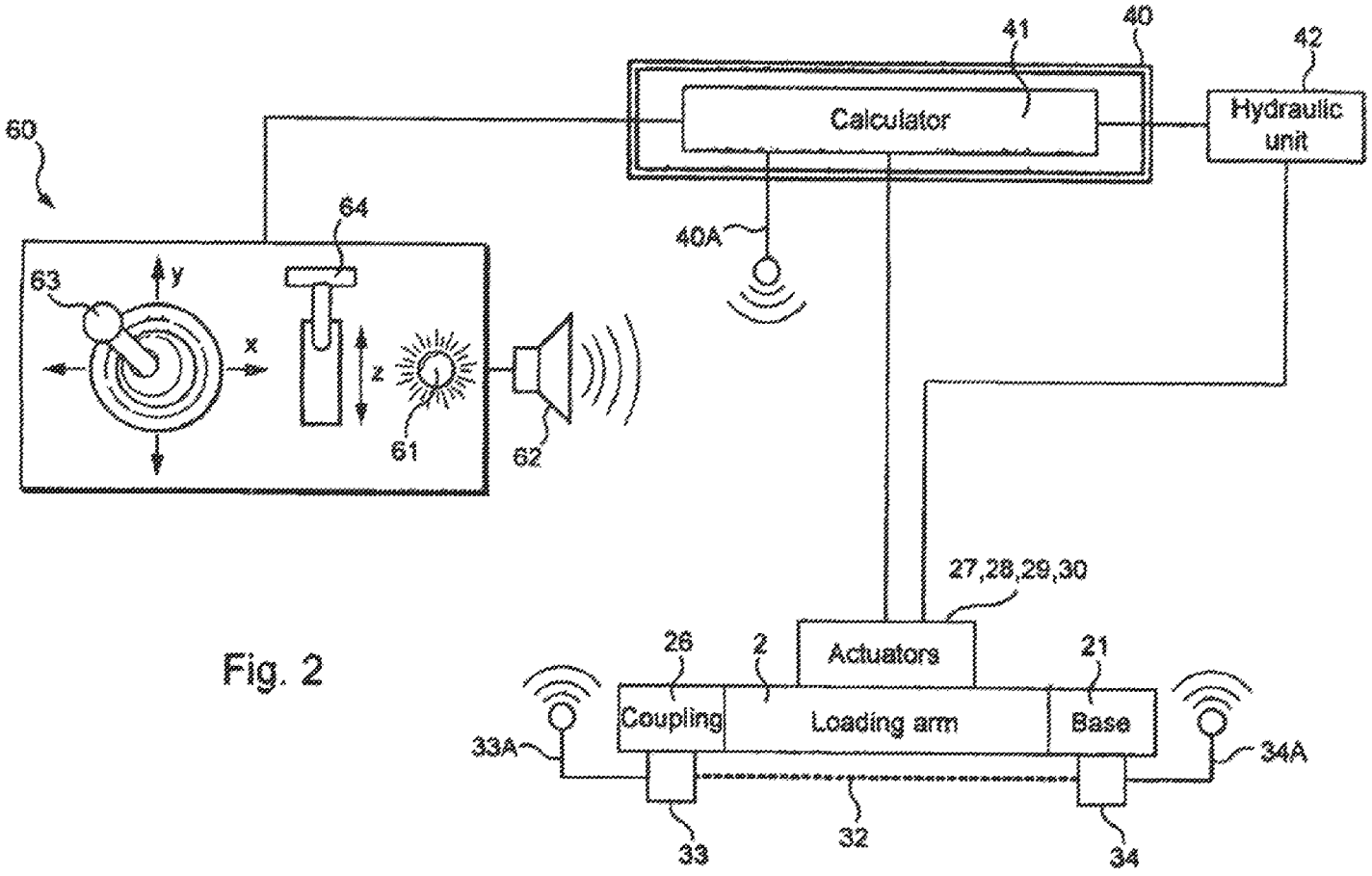
FIG. 2 is an synoptic diagram of the operation of the arm according to FIG. 1.

As can be seen more particularly in FIG. 2, in the synoptic diagram of the operation of the device according to FIG. 1, the calculator 41 is linked to the receiver device 40A, which is a radio receiver, adapted to communicate with the radio transmitter devices 33A and 34A respectively linked to the boxes 33 and 34 of the coupling and of the base. The boxes thus provide the calculator with the information on the positioning of the coupling and of the base using the devices of a system for global positioning of GPS type and using the laser beam 32 and corresponding emitter and receiver.

In an alternative embodiment, the devices for a system for global positioning of GPS type are devices designed to communicate with each other so as to calculate then provide information directly to the calculator on the relative position of the coupling relative to the base.

In an alternative embodiment, when the base is fixed to a quay, there is only a single device of a system for global positioning of GPS type. It is positioned at the coupling to give the absolute positioning coordinates thereof and a calculating means is provided to calculate, from positioning coordinates of the base which is fixed in space and from the absolute positioning coordinates of the coupling, the relative positioning coordinates of the coupling directly relative to the base. Indeed, as the base is fixed in space, its coordinates are known, and it is thus not necessary to provide a GPS device at the base.

The hydraulic power unit 42 supplies the actuators with the hydraulic energy necessary for their operation. It is controlled by the calculator via power relays to control the starting and stopping of the hydraulic power unit. The hydraulic unit comprises a pump (not represented) adapted to pump a hydraulic fluid to supply the actuators.

As can be seen more particularly in FIG. 2, the command interface 60 is linked to the calculator 41 to enable an operator to control the movement of the coupling according to the x and y axes via a lever 63 and according to the z axis via a lever 64, the axes being diagrammatically represented in FIG. 1. The calculator sends the corresponding instructions to the actuators 27, 28, 29 which control the movements of the loading arm 2. In the embodiment represented, the actuators are proportional actuators, and the levers 63 and 64 are proportional control levers. The calculator is adapted to calculate instructions for each of the actuators such that a proportional command according to one of the axes via one of the levers results in a proportional movement of the coupling along the corresponding axis.

The command interface furthermore comprises a visual alarm indicator 61 and an alarm horn 62. The visual indicator 61 and the horn 62 are triggered when the coupling leaves an authorized zone parameterized in the calculator 41.

Figure 3:
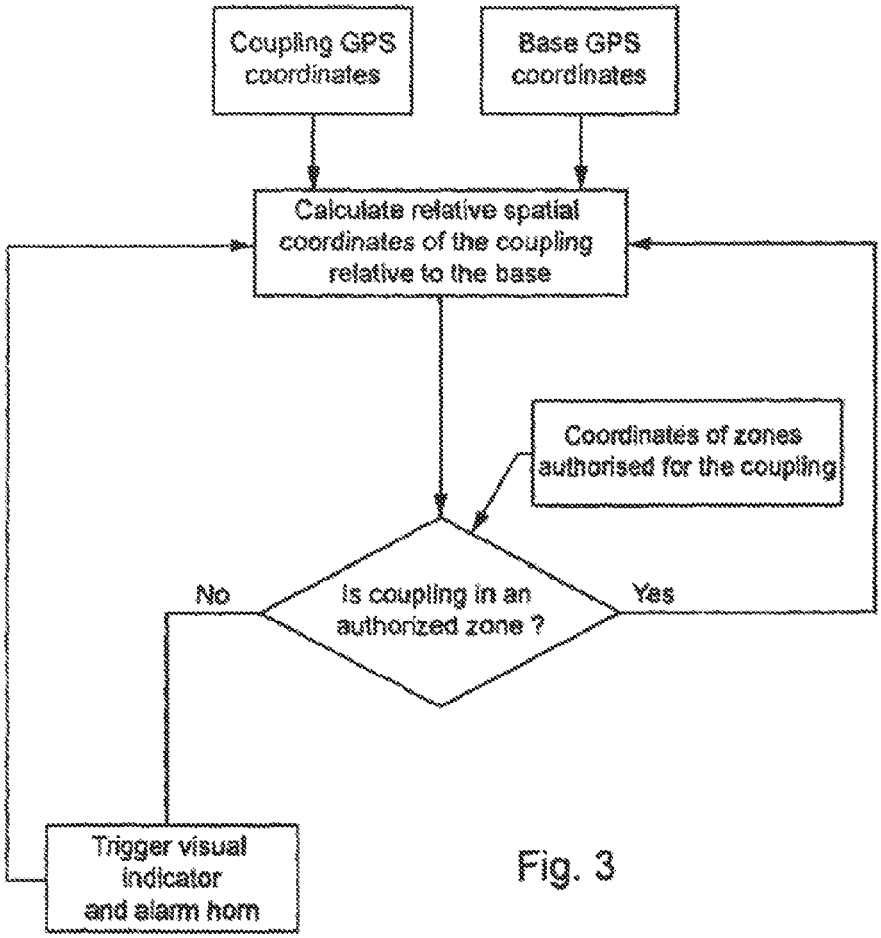
FIG. 3 is a function diagram to represent the general principle of operation of the control device according to FIGS. 1 and 2.

As can be seen more particularly in FIG. 3, coordinates of zones authorized for the coupling are parameterized in the calculator 41. According to the coordinates provided by the boxes 33 and 34, the calculator calculates the relative spatial coordinates of the coupling relative to the base, then compares these coordinates with the coordinates of the zones authorized for the coupling. When the coupling is situated in an authorized zone, the calculator loops to calculate the relative spatial coordinates of the coupling relative to the base in real time according to the coordinates provided to it by the boxes 33 and 34 which were able to determine a movement of the coupling in the meantime. When the calculator determines that the coupling is not in an authorized zone, it triggers the visual alarm indicator and the alarm horn.

In other words, the calculator calculates, in real time, information on positioning of the coupling relative to the base according to the movements of the coupling and the information provided by the means for providing information on positioning of the coupling, and the calculator is parameterized with data defining at least one positioning zone authorized for the coupling and is adapted to verify in real time whether the coupling is located in the authorized zone and to trigger an alarm where appropriate. Advantageously, the fact of providing such authorized zones or working zones makes it possible to avoid a risk of damage to the system in particular by rupture or interference when the coupling is moved too far from the base during extension or rotation.

The use of the laser beam 32 makes it possible to obtain very precise information on the distance between the base and the coupling. This information is taken into account by the calculator in correlation with the GPS coordinates of the coupling to calculate the relative coordinates of the coupling relative to the base with greater precision.

In this connection it is to be recalled that the device according to the invention operates with a single type of means for providing information on positioning, for example by GPS. In the variant presented here, the use of two types of means for providing information on positioning, by combining GPS and laser, enables the characteristics of the two different technologies to be taken advantage of to obtain more precise and more reliable positioning information.

When the distance information provided by the use of the laser beam deviates relative to the distance information calculated on the basis of the GPS coordinates beyond a certain threshold that is predefined and parameterized in the calculator, the latter informs the operator thereof by emitting a corresponding alarm, for example a luminous or audio alarm. This provision improves the reliability of the device.

Preferably, the laser is of tracker type, that is to say that it is capable of following its target, for example the coupling, and to provide the calculator directly with the distance between itself and its target according to the three axes x, y, and z. The laser beam and the corresponding operation as described above has been omitted in FIG. 3 in the interest of clarity.

According to an embodiment not represented, two authorized zones overlapping one within the other are parameterized in the calculator. The first zone does not present any particular danger for the coupling and the second authorized zone presents a relatively low degree of danger. Once this second zone has been left, the degree of danger becomes higher. When the coupling enters the second zone, the indicator and the horn are triggered intermittently, to warn the user that he is leaving the risk-free zone for a zone of moderate risk. When the coupling leaves this second zone, the indicator and the horn are triggered continuously to indicate to the operator that the degree of danger is high.

Advantageously, according to an embodiment that is not illustrated, the calculator is configured to inhibit the control instructions for movement of the actuators the consequence of which would be to make the coupling leave authorized zone. Thus, even if the operator gives such a control instruction, the coupling will not leave the authorized zone.

Advantageously, according to an embodiment not represented, the calculator is programmable so as to define working zones and/or forbidden zones which may be parameterized by the operator according to each loading or unloading operation of fluid products. This makes it possible, for example, to adapt the automatic connection procedure to different ships which may have different possible collisions zones.

According to an embodiment not represented, the calculator is adapted to calculate in real time the speed of movement of the coupling and to trigger alarm in anticipation when the coupling approaches the limit of the corresponding authorized zone too fast. The speeds and distances relative to the limit of a corresponding authorized zone are parameterized in the calculator.

In an embodiment that is not represented, several marine loading systems are connected to the same calculator 40, and a selector is provided at the command interface to selectively control the connection of one or the other of the loading systems linked to the calculator. Working zones corresponding to the neighboring loading system are programmed so as to avoid collisions between the different loading systems.

Figure 4:
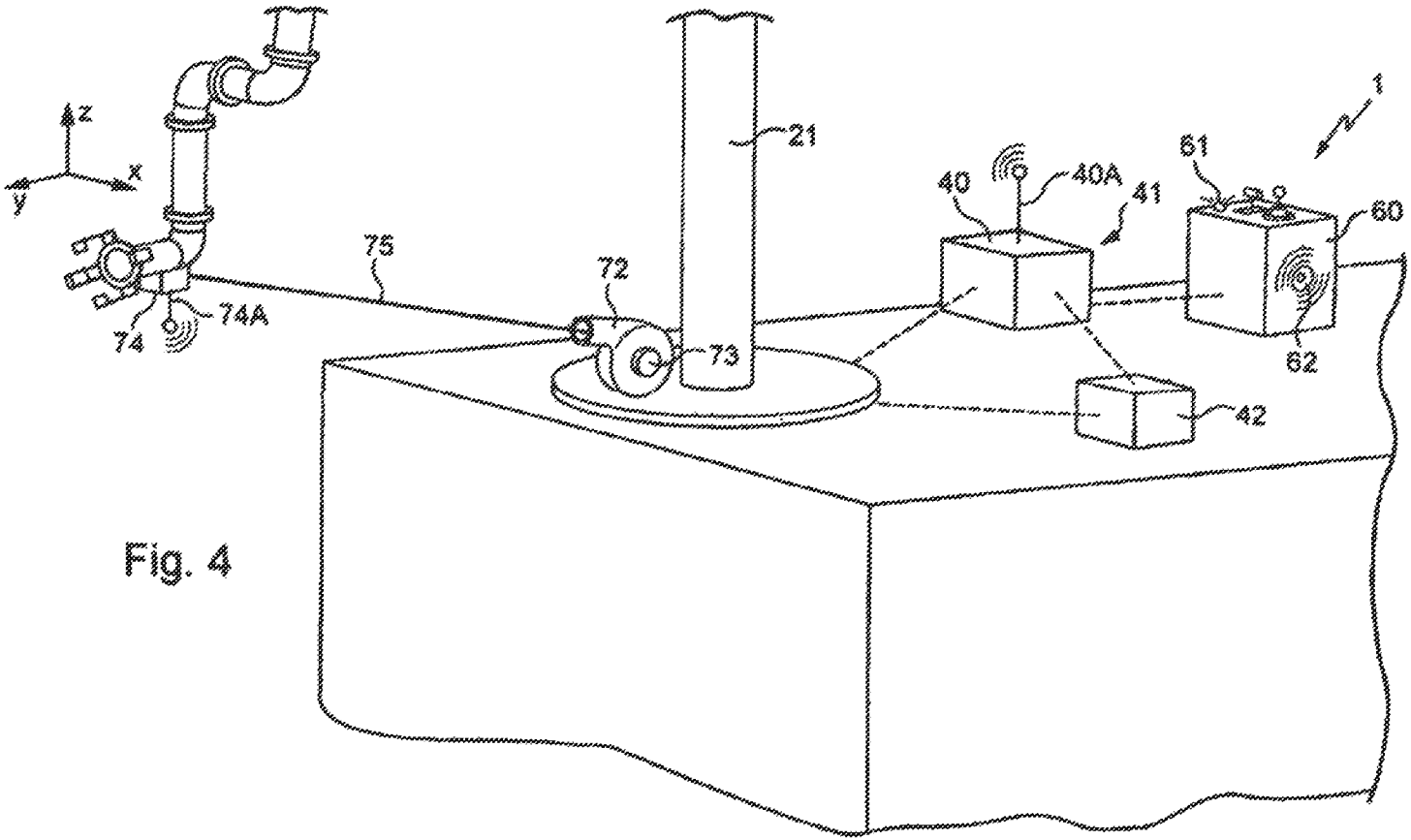
FIG. 4 is a diagrammatic view in perspective of another embodiment of a loading arm equipped with a device according to the invention.

FIG. 4 is a diagrammatic view in perspective of another embodiment of a loading arm equipped with a device for providing information on positioning of the coupling according to the invention, in which the means for providing information on positioning of the coupling is a tensioned cord between the base and the coupling. At one of its ends, the cord 75 comprises means for fastening to the coupling. The other end of the cord is attached to the drum of a reel 72, itself mounted on the base. The reel comprises an incremental sensor 73 making it possible to determine the length of cord unwound, this information being sent to the calculator which deduces therefrom the distance between the coupling and the base.

Furthermore, an angle sensor 74 of the cord is provided for the cord 75, in order to determine in inclination of the cord relative to at least two reference angles. The angle sensor is provided with an transmitter device 74A to communicate with the receiver device 40A linked to the calculator 41. The incremental sensor 73 is linked by a wire connection to the calculator 41. In this way, it is possible to determine the relative positioning of the coupling relative to the base on the basis of the two reference angles and the distance of the unwound cord 75. The angle sensor is for example a sensor which uses an inclinometer or a laser to determine the inclination of the cord relative to said at least two reference angles. Alternatively, the angle sensor is disposed at the outlet of the reel 72.

As a variant, the device is provided with a plurality of reels of which the cords are attached at separate places, such that on the basis solely of the information on the unwound distances provided by the reel sensors, the calculator calculates the angles and the distance for the relative positioning of the coupling relative to the base.

According to a variant that is not illustrated, the reel is provided with a cord breakage detector. A corresponding warning is then communicated to the operator via the command interface for example by an indicator light indicating the breakage of the cord.

Apart from the differences described above, structurally and functionally this embodiment is the same as the embodiment of FIGS. 1 to 3, and it will not therefore be described in more detail here.

Generally, in a variant that is not illustrated which applies to all the embodiments described above, several arms are controlled by the same calculator. A selector provided on the command interface enables a plurality of loading arms, linked to the same calculator, to be controlled using the same principle and with the same command interface. The authorized zones in the calculator for each of the arms correspond to the movements of neighboring arms and are either parameterized or redefined in real time depending on the movements of the neighboring arms.

In another general variant that is not illustrated, the command interface is a remote control unit provided with a transmitter for wireless communication with a receiver linked to the calculator in the electrical control cabinet. The transmitter and receiver communicate by radio waves. As a variant, the transmitter and the receiver communicate by optical waves, for example infrared waves.

According to another embodiment of the invention that is not represented, a loading arm is equipped with a device for providing information on positioning of the coupling according to the invention, in which the means for providing information on positioning of the coupling is a camera mounted on the base. A target is disposed on the coupling. The camera is designed to focus on the target and provide the calculator with an image of the target. On the basis of that image, the calculator is adapted to calculate the relative positioning of the coupling relative to the base.

To that end, the calculator is provided with an algorithm for processing the image and for shape recognition in order to determine the distance and the angle so as to deduce therefrom the relative positioning of the coupling relative to the base. For the calculation of the distance, the algorithm uses the principle whereby the greater the distance between the coupling and the base, the smaller the image of the target, and for the calculation of the angle, the principle whereby, for a circular target, when the coupling is along the axis of the target duct, the image of the target is circular, and when the coupling is axially offset relative to the target duct, the image of the target is elliptical.

In another variant, several cameras are disposed to focus on the same target and provide several images to the calculator, the latter being adapted to process all these images to calculate the relative positioning of the coupling relative to the base.

In another embodiment, a camera is mounted on a motorized support, itself controlled by calculating means to pivot in order to be continuously oriented towards the target and enabling the angular orientation of the camera relative to the base to be known at any time, the calculating means being adapted to process this angular orientation information and the image sent by the camera to determine the relative positioning of the coupling relative to the base.

Preferably, for reasons of performance, the target is a reflective sighting device.

When the loading system comprises several lines, their bases are disposed in parallel on the same quay and the corresponding couplings are connected to target ducts disposed in parallel on the same ship. In this case, the distances between the couplings no longer vary, since they are connected to target ducts attached to the same ship. It is then useful to check relative to each other the possible variations in distance between the couplings in order to verify the consistency of the information provided by the various means for providing information on positioning of the couplings and the proper operation of those means. To that end, the present invention provides a device which is termed a correlation device.

When the loading system comprises several lines, their bases being disposed on the same quay and the corresponding couplings are connected to target ducts disposed on the same ship, the calculator calculates the distances between the couplings immediately after the connection and saves the results. Next, the calculator continues to calculate, in real time, the distances between the couplings and compares them in real time to the values saved.

When the calculated values vary relative to the values saved by more than a predetermined threshold parameterized in the calculator, the latter emits an alarm to indicate to the operator that the means for providing information on positioning of a coupling are defective. It may for example be an indicator light.

When the loading system comprises three or more lines, the calculator emits an alarm indicating which coupling appears to have a defect in the means for providing information on positioning of the coupling. It may for example be an indicator light with a marker for designating the corresponding arm.

Such a correlation device makes it possible to rapidly identify a means for providing information on positioning of the defective coupling.

Numerous other variants are possible according to circumstances, and in this connection it is to be noted that that the invention is not limited to the examples represented and described.

The invention claimed is:

1. A device for providing information on the positioning of at least one moveable coupling which is located on a movable end of a fluid transfer line of a marine loading system and is adapted for connection to a target duct, the other end of the fluid transfer line being fixed to a base, the device comprising:

at least one first means for providing information on the positioning of the coupling, said first means being positioned on the coupling or on a member immediately neighboring the coupling and including a first GPS device for providing information on the absolute positioning of the coupling in space;

wherein either:

the device comprises a second means adapted to cooperate directly with the first means for providing information on the positioning of the base, said second means being disposed on the base or on a member immediately neighboring the base and providing, on the basis of the information on the positioning of the base and the information on the positioning of the coupling, information on the relative positioning of the coupling directly relative to the base; or the first means is adapted to provide information on the absolute positioning of the coupling in space, the base has a fixed position in space, and the device comprises a calculating means for calculating, on the basis of the information on the absolute positioning of the coupling and data on positioning of the base, information on the relative positioning of the coupling directly relative to the base.

2. A device according to claim 1, wherein the calculating means comprises data defining at least one authorized positioning zone for the coupling and is adapted to:

calculate in real time the information on the positioning of the coupling relative to the base;

check in real-time whether the coupling is located within the authorized zone; and emit a specific alarm when the coupling leaves the authorized zone.

3. A device according to claim 2, wherein the calculating means is adapted to calculate in real time the speed of movement of the coupling and to trigger an alarm when the coupling approaches a limit of the corresponding authorized zone with a speed grater than a predetermined speed.

4. A device according to claim 2, wherein at least one of the first and second means includes an optical device which is adapted to cooperate with the base or the coupling, respectively, or a target fixed relative to the base or the coupling, respectively, by emitting a luminous beam towards the base or the coupling, or the target fixed relative to the base or the coupling, detect the reflected beam, measure the travel time of the beam and deduce therefrom information on the relative positioning of the coupling directly relative to the base.

5. A device according to claim 2, wherein at least one of the first and second means comprises an optical camera which is adapted to provide to the calculating means an image of the base or the coupling, respectively, or of a target fixed relative to the base or the coupling, respectively, and wherein the calculating means is adapted to process the image and calculate the relative positioning of the coupling relative to the base.

6. A device according to claim 2, wherein at least one of the first and second means includes:

at least one cord which is tensioned between the coupling and the base using a reel; and at least one of an angle sensor and a cord unwound length sensor;

wherein the calculating means is adapted to calculate the relative positioning of the coupling relative to the base from information provided by said angle sensor or said cord unwound length sensor.

7. A device according to claim 2, wherein the loading system comprises several fluid transfer lines whose corresponding bases are disposed on a mutual quay and whose corresponding couplings are connectable to respective target ducts disposed on a mutual same ship, and wherein the calculating means is configured to calculate, on the basis of the information on the positioning of the couplings, the distances between the couplings immediately after the connection of the couplings to their corresponding target ducts, store said distances as reference distances, calculate in real time the distances between the couplings on the basis of the information on positioning of the couplings, compare in real time the calculated distances with the reference distances, and emit an alarm when the calculated distances vary relative to the reference distances beyond a predefined threshold.

8. A device according to claim 1, wherein the second means includes a second GPS device for providing information on the absolute positioning of the base in space and the calculating means is adapted to calculate, on the basis of the information on the absolute positioning of the coupling in space and the absolute positioning of the base in space, the relative positioning of the coupling relative to the base.

9. A device according to claim 8, wherein the first and second GPS devices are configured to communicate with each other so as to provide the information on the relative positioning of the coupling relative to the base directly to the calculating means.

10. A method for providing information on the positioning of at least one moveable coupling which is located on a movable end of a fluid transfer line of a marine loading system and is adapted for connection to a target duct, the other end of the fluid transfer line being fixed to a base, the method comprising:

determining in real time the absolute positioning of the coupling in space;

calculating in real time information on the positioning of the coupling relative to the base from information on the positioning of the base and the information on the absolute positioning of the coupling in space;

checking in real-time whether the coupling is located within a pre-defined authorized zone for the coupling; and emitting a specific alarm when the coupling leaves the authorized zone.

11. In a marine loading system comprising at least one fluid transfer line having a first end fixed to a base and a moveable second end provided with a coupling adapted for connection to a target duct, the improvement comprising a device for providing information on the positioning of the coupling, said device comprising:

at least one first means for providing information on the positioning of the coupling, said first means being positioned on the coupling or on a member immediately neighboring the coupling and including a first GPS device for providing information on the absolute positioning of the coupling in space;

wherein either:

the device comprises a second means adapted to cooperate directly with the first means for providing information on the positioning of the base, said second means being disposed on the base or on a member immediately neighboring the base and providing, on the basis of the information on the positioning of the base and the information on the positioning of the coupling, information on the relative positioning of the coupling directly relative to the base; or the first means is adapted to provide information on the absolute positioning of the coupling in space, the base has a fixed position in space, and the device comprises a calculating means for calculating, on the basis of the information on the absolute positioning of the coupling and data on positioning of the base, information on the relative positioning of the coupling directly relative to the base.

12. A marine loading system according to claim 11, wherein the calculating means comprises data defining at least one authorized positioning zone for the coupling and is adapted to:

calculate in real time the information on the positioning of the coupling relative to the base;

check in real-time whether the coupling is located within the authorized zone; and emit a specific alarm when the coupling leaves the authorized zone.

13. A marine loading system according to claim 12, wherein the calculating means is adapted to calculate in real time the speed of movement of the coupling and to trigger an alarm when the coupling approaches a limit of the corresponding authorized zone with a speed grater than a predetermined speed.

14. A marine loading system according to claim 12, wherein at least one of the first and second means includes an optical device which is adapted to cooperate with the base or the coupling, respectively, or a target fixed relative to the base or the coupling, respectively, by emitting a luminous beam towards the base or the coupling, or the target fixed relative to the base or the coupling, detect the reflected beam, measure the travel time of the beam and deduce therefrom information on the relative positioning of the coupling directly relative to the base.

15. A marine loading system according to claim 12, wherein at least one of the first and second means comprises an optical camera which is adapted to provide to the calculating means an image of the base or the coupling, respectively, or of a target fixed relative to the base or the coupling, respectively, and wherein the calculating means is adapted to process the image and calculate the relative positioning of the coupling relative to the base.

16. A marine loading system according to claim 12, wherein at least one of the first and second means includes:

at least one cord which is tensioned between the coupling and the base using a reel; and at least one of an angle sensor and a cord unwound length sensor;

wherein the calculating means is adapted to calculate the relative positioning of the coupling relative to the base from information provided by said angle sensor or said cord unwound length sensor.

17. A marine loading system according to claim 12, wherein the loading system comprises several fluid transfer lines whose corresponding bases are disposed on a mutual quay and whose corresponding couplings are connectable to respective target ducts disposed on a mutual same ship, and wherein the calculating means is configured to calculate, on the basis of the information on the positioning of the couplings, the distances between the couplings immediately after the connection of the couplings to their corresponding target ducts, store said distances as reference distances, calculate in real time the distances between the couplings on the basis of the information on positioning of the couplings, compare in real time the calculated distances with the reference distances, and emit an alarm when the calculated distances vary relative to the reference distances beyond a predefined threshold.

18. A marine loading system according to claim 11, wherein the second means includes a second GPS device for providing information on the absolute positioning of the base in space and the calculating means is adapted to calculate, on the basis of the information on the absolute positioning of the coupling in space and the absolute positioning of the base in space, the relative positioning of the coupling relative to the base.

19. A marine loading system according to claim 18, wherein the first and second GPS devices are configured to communicate with each other so as to provide the information on the relative positioning of the coupling relative to the base directly to the calculating means.

* * * * *